US009370456B2

(12) United States Patent
Balderson

(10) Patent No.: US 9,370,456 B2
(45) Date of Patent: Jun. 21, 2016

(54) CHAIR ASSEMBLY

(71) Applicant: Robert J. Balderson, Riley Township, MI (US)

(72) Inventor: Robert J. Balderson, Riley Township, MI (US)

( * ) Notice: Subject to any disclaimer, the term of this patent is extended or adjusted under 35 U.S.C. 154(b) by 0 days.

(21) Appl. No.: 14/551,807

(22) Filed: Nov. 24, 2014

(65) Prior Publication Data

US 2016/0143794 A1 May 26, 2016

(51) Int. Cl.
*A61G 5/10* (2006.01)
*A61G 5/12* (2006.01)

(52) U.S. Cl.
CPC .. *A61G 5/12* (2013.01); *A61G 5/10* (2013.01); *A61G 2005/125* (2013.01)

(58) Field of Classification Search
CPC ..... A61G 5/12; A61G 5/10; A61G 2005/125; A61G 5/14
See application file for complete search history.

(56) References Cited

U.S. PATENT DOCUMENTS 129,537 A * 7/1872 Crosscup ..... A47C 1/023 297/107
177,050 A * 5/1876 Wood ..... A47C 17/12 297/116
562,920 A * 6/1896 Salquist ..... A47C 13/00 297/105
1,082,680 A * 12/1913 Danielson ..... A47C 17/16 297/116
1,137,325 A * 4/1915 Jacobsen ..... A47C 17/12 297/116
2,053,349 A * 9/1936 Nordmark ..... B60N 2/3011 297/116
2,621,708 A * 12/1952 Luce, Jr. ..... A47C 1/122 297/117
2,790,485 A * 4/1957 Franklin ..... A47C 17/12 297/116
3,023,048 A * 2/1962 Barton ..... A61G 5/14 280/200
3,072,437 A * 1/1963 Shea ..... A61G 5/12 297/423.32
3,249,388 A * 5/1966 Jennings ..... A61G 5/12 248/279.1
3,381,973 A 5/1968 Carr
3,574,399 A * 4/1971 Udden ..... A61G 5/045 180/69.6
3,618,968 A 11/1971 Greer
3,901,527 A 8/1975 Danziger et al.
4,155,588 A * 5/1979 Danziger ..... A61G 5/00 297/115
5,060,960 A * 10/1991 Branscumb ..... A61G 5/10 280/250.1
5,378,041 A * 1/1995 Lee ..... A61G 5/1067 280/250.1
5,458,349 A * 10/1995 Mung-Tung ..... A61G 5/14 180/6.5

(Continued)

FOREIGN PATENT DOCUMENTS

EP 0634158 A1 1/1995

*Primary Examiner* — Anne Marie Boehler
*Assistant Examiner* — Gabriela C Craciun

(57) ABSTRACT

A chair assembly includes a chair portion and an armrest portion coupled to the chair portion movable between an upright position and an extended position. The armrest portion includes a body. A support is attached to the body disposed adjacent to the seat. In the upright position, the support is disposed generally perpendicular to the seat. In the extended position, the support is disposed generally parallel to the seat. A structure includes a rod being pivotably attached to the support. The structure also includes a brace pivotably attached to the rod and the chair portion movable between a storage position and a load bearing position. In the storage position, the rod is disposed generally parallel to the support with the armrest portion in the upright position. In the load bearing position, the rod is disposed generally perpendicular to the support with the armrest portion in the extended position.

20 Claims, 3 Drawing Sheets

(56) References Cited

U.S. PATENT DOCUMENTS

| | | | | |
|---|---|---|---|---|
| 5,651,149 | A | 7/1997 | Garman | |
| 6,361,267 | B1 | 3/2002 | Chuang | |
| 6,748,612 | B1 | 6/2004 | Cerne et al. | |
| 7,093,904 | B1 | 8/2006 | McMillen | |
| 8,186,701 | B2 | 5/2012 | Sim et al. | |
| 8,544,866 | B2 | 10/2013 | Noonan et al. | |
| 2002/0179782 | A1* | 12/2002 | Smeed | A61G 5/12 248/118 |
| 2003/0189361 | A1 | 10/2003 | Chen et al. | |
| 2014/0062054 | A1* | 3/2014 | Schaaper | B60B 1/02 280/250.1 |

* cited by examiner

CHAIR ASSEMBLY

BACKGROUND

1. Field of the Disclosure

The present disclosure relates to a chair assembly.

2. Description of the Prior Art

A disabled individual often employs a wheelchair to transport. One such chair assembly includes a chair portion having a seat and a back. An armrest portion is pivotably attached to the chair portion. The armrest portion has a support disposed adjacent to the chair portion. The armrest portion is moveable between an upright position and an extended position. In the upright position, the support is generally perpendicular to the seat. In the extended position the support is generally parallel to the seat. A structure includes a rod is pivotably attached to the support adjacent to one end of the rod.

To transfer the disabled individual from the chair assembly, the disabled individual moves the armrest portion from the upright position to the extended position. When the armrest portion is in the extended position, the rod buttresses the support in response to an added weight to the armrest portion. However, there may be some deficiencies associated with the chair assembly.

SUMMARY

The present disclosure provides for a structure including a rod and a brace being moveable relative to the chair portion and the support. The rod and the brace are generally parallel to the support when the armrest portion is in the upright position. The rod is generally perpendicular to the support when the armrest portion in the extended position and the brace is generally parallel to the support when the armrest portion in the extended position.

The present disclosure further provides for the structure including a brace pivotably attached to the rod and the chair portion with the brace allowing the rod to move between a storage position and a load bearing position. In the storage position, the rod is generally parallel to the support and when the armrest portion is in the upright position. In the load bearing position, the rod is generally perpendicular to the support when the armrest portion is in the extended position.

The present disclosure eliminates the need of folding the structure into the armrest portion to store the structure when the armrest portion is in the upright position.

The present disclosure also provides reliable support to the armrest portion when the armrest position is in the load bearing position to allow an even weight distribution between the seat and the armrest portions.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION

Figure 1:
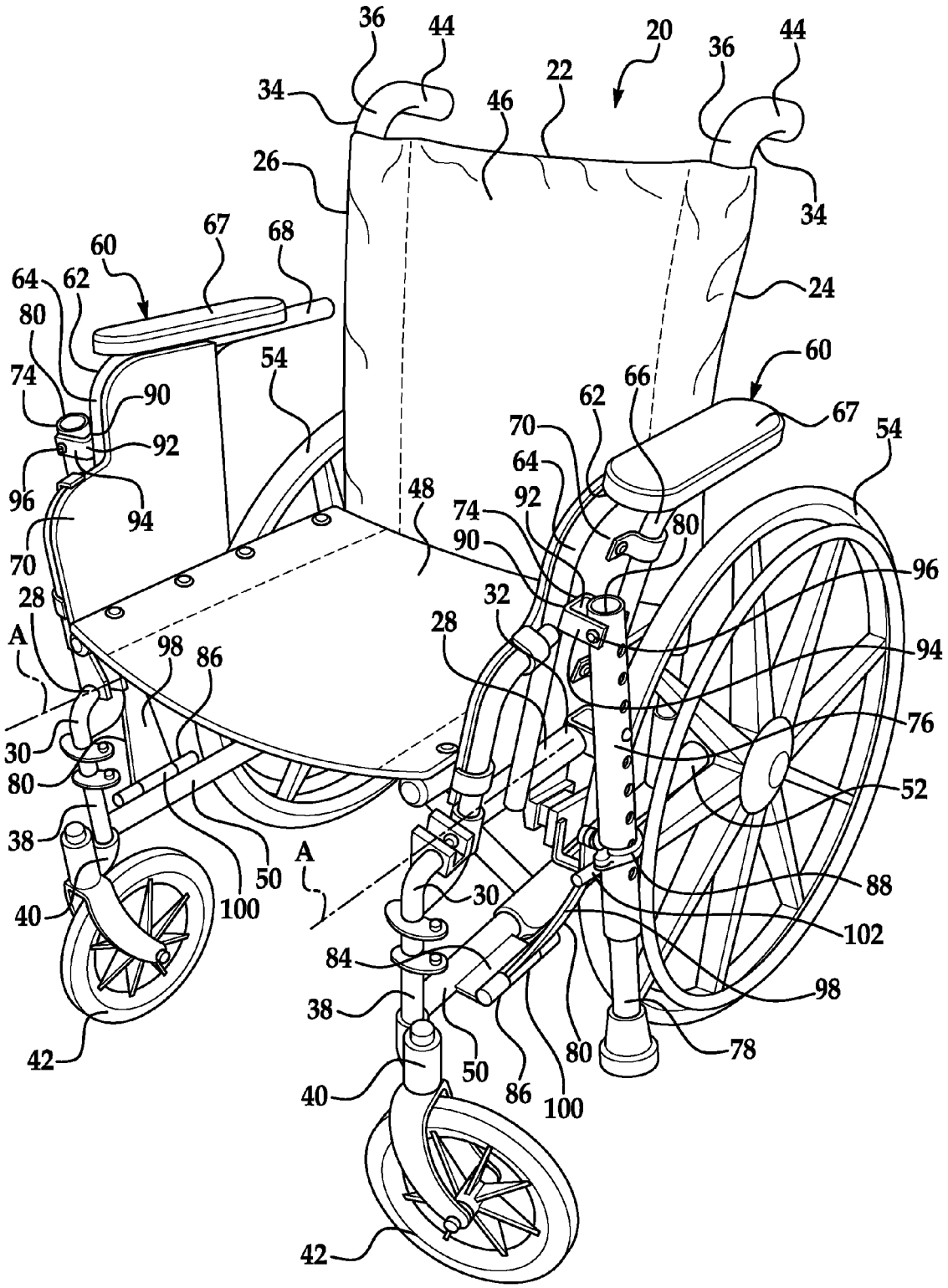
FIG. 1 is a perspective view of the chair assembly.

Referring to the Figures, wherein like numerals indicate corresponding parts throughout the several views, a chair assembly 20 is generally shown in FIG. 1.

The chair assembly 20, as generally shown in FIG. 1, includes a chair portion 22. The chair portion 22 has a pair of frames 24, 26 includes a first frame 24 and a second frame 26. Each of the frames 24, 26 has a lower case "h"-shape disposed parallel to and spaced apart from one another. Each of the frames 24, 26 includes a cross member 28 disposed on a center axis A extending between a front end 30 and a rear end 32.

Each of the frames 24, 26 also includes a vertical member 34 extending outwardly from the rear end 32 of the cross member 28 to a distal end 36 perpendicular to the center axis A. The cross member 28 includes a leg 38 extending outwardly from the front end 30 perpendicular to the cross member 28 and in a direction opposite of the vertical member 34 to a joint end 40. In addition, each of the frames 24, 26 includes a caster 42 rotatably attached to the joint end 40 to allow an individual to change the direction of the chair. In other words, the caster 42 is free to rotate about the joint end 40 of the leg 38 to allow the individual to change the direction of the wheelchair. The caster 42 may be coupled to the joint end 40 using conventional methods of joining two objects, e.g. adhesives, welding.

The vertical member 34 of the frames 24, 26 includes a handle 44 disposed at the distal end 36 extending outwardly and perpendicularly from the vertical member 34. A cushion 46 extends between the vertical member 34 of the frames 24, 26 connecting the vertical members 34 to one another to define a back for supporting the back of the individual. A mat 48 extends between the cross member 28 of the frames 24, 26 connecting the cross members 28 with one another to define a seat to allow the individual to sit.

Each of the frames 24, 26 includes a base member 50 disposed spaced apart from the cross member 28 extending outwardly from the leg 38 parallel to the center axis A to a base member end 52. A pair of wheels 54 is disposed spaced apart from one another and rotatably coupled to the base member end 52. The wheels 54 may be coupled to the base member ends 52 by using conventional methods of joining two objects, e.g. adhesives, welding. The chair portion 22 is sandwiched between the wheels 54. The wheels 54 may be at an acute angle of less than 90° relative to the seat to provide an even weight distribution of the individual. Each of the frames 24, 26 further includes a brake 56 having a lever 58 pivotably attached to the cross member 28 of the frames 24, 26 and adjacent to the cushion 46 and the armrest portion 60 for engaging the wheels 54 to prevent the wheels 54 from rotating.

Figure 2:
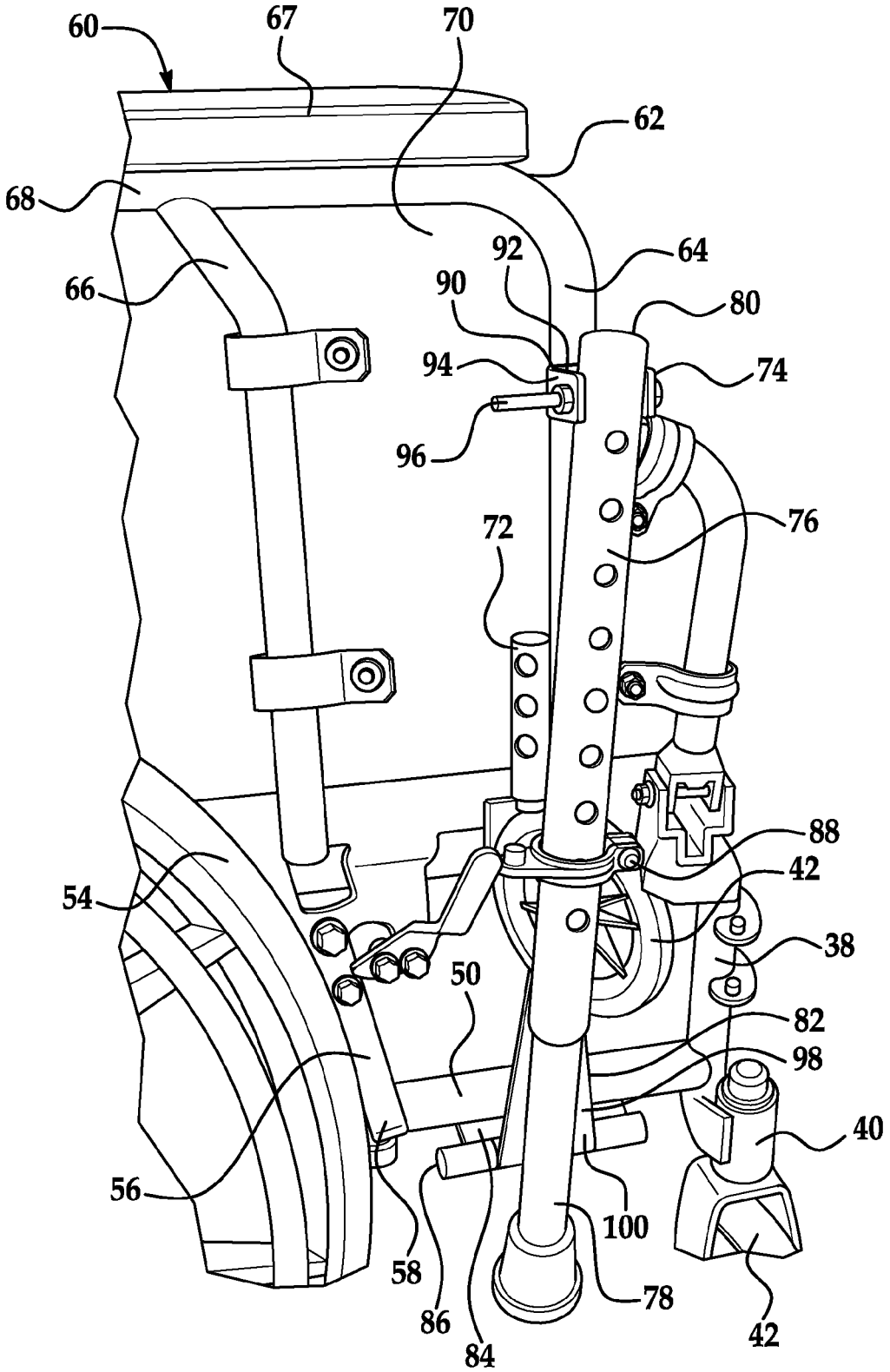
FIG. 2 is an enlarged fragmentary view of the armrest portion in the upright position.
Figure 3:
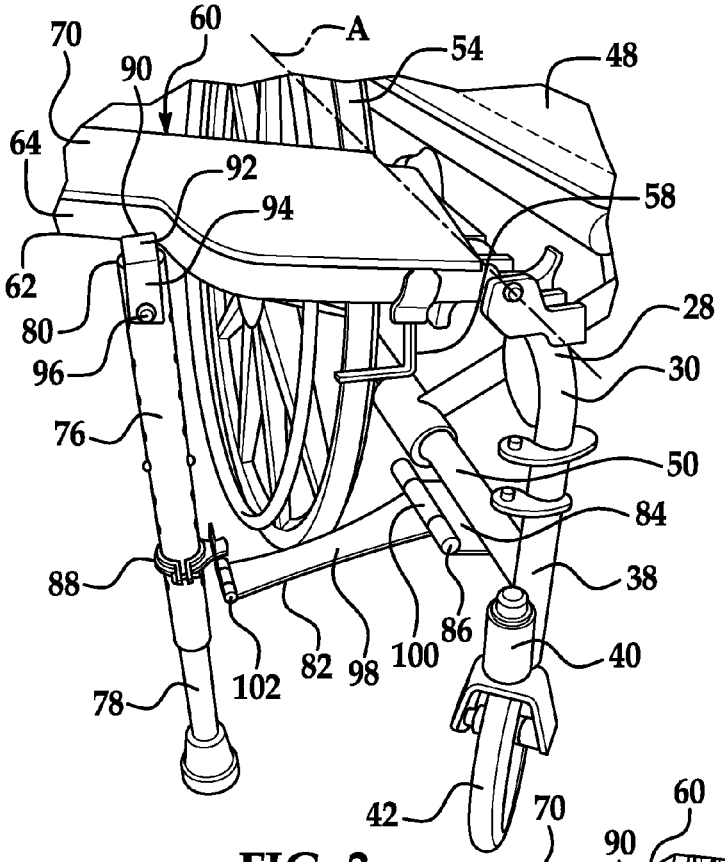
FIG. 3 is an enlarged fragmentary view of the armrest portion in the extended position.

An armrest portion 60, as generally indicated in FIGS. 1 and 2, is pivotably coupled to the chair portion 22 and movable between an upright position as best shown in FIG. 2 and an extended position as best shown in FIG. 3. The armrest portion 60 includes a body 62 having a "C"-shape defining a pair of arms 64, 66 having a first arm 64 and a second arm 66 disposed spaced apart from one another. The arms 64, 66 are also pivotably attached to the cross member 28 of the chair portion 22 to allow the movement of the armrest portion 60 between the upright position and the extended position. The arms 64, 66 may be welded to the cross members 28 of the chair portion 22, of course, the armrest portion 60 may be attached to the cross member 28 using a pin as another method of attachment. The body 62 further includes an intermediate member 68 connecting the arms 64, 66 with one another and defining the "C"-shape. The armrest portion 60 also includes a pad 67 being disposed on the intermediate member 68 of the body 62 extending along the intermediate member 68 to allow the arms 64, 66 of the individual to rest on the pad 67.

A support 70 is attached to the body 62 of the armrest portion 60 and disposed adjacent to the seat. When the armrest portion 60 is in the upright position, the support 70 is disposed generally perpendicular to the seat. When the armrest portion 60 is in the extended position, the support 70 is disposed in generally parallel to the seat to allow the individual to lie across the support 70 and the seat. The term "generally parallel" or "generally perpendicular" does not only include the support 70 being aligned with the seat or being perpendicular to the seat. The term "generally parallel" should include the support 70 being within 30° relative to the seat. The term "generally perpendicular" should include the support 70 being within 120° relative to the seat. In the illustrated example, the support 70 is a panel as shown in FIG. 1. Alternatively, instead of a panel, the support 70 can be a framework, a web, or a mesh to allow the individual to lie across the support 70 and the seat. A fastener 72 is attached to the cross member 28 of the frames 24, 26 and the body 62 for engaging the chair portion 22 to lock the armrest portion 60 to the chair portion 22 in the upright position.

A structure 74 including a rod 76, 78 of cylindrical shape is pivotably attached to the support 70 of the armrest portion 60. The rod 76, 78 includes a first pipe 76 and a second pipe 78 disposed in a telescopic relationship with one another. The rod 76, 78 is also attached to the armrest portion 60 adjacent to one end 80 of the rod 76, 78. The structure 74 also includes a brace 82 pivotably attached to the rod 76, 78 and the chair portion 22. The brace 82 allows the rod 76, 78 to move between a storage position and a load bearing position. When the rod 76, 78 is in the storage position, the rod 76, 78 is disposed generally parallel to the support 70 with the armrest portion 60 in the upright position. When the rod 76, 78 is in the load bearing position, the rod 76, 78 is disposed generally perpendicular to the support 70 with the armrest portion 60 in the extended position. In other words, the rod 76, 78 and the brace 82 of the structure 74 are moveable relative to the chair portion 22 and the support 70. When the armrest portion 60 is in the upright position, the rod 76, 78 and the brace 82 are generally parallel to the support 70. When the armrest portion 60 is in the extended position, the rod 76, 78 is generally perpendicular to the support 70 and the brace 82 is generally parallel to the support 70.

The structure 74 includes a fin 84 having a rectangular shape attached to the base member 50 of the frames 24, 26. The fin 84 extends outwardly from the frames 24, 26 to a fin end 86 perpendicular to the base member 50 of the frames 24, 26.

A clamp 88 having a circular shape is slidably disposed about the rod 76, 78 and pivotably attached to the brace 82 connecting the brace 82 to the rod 76, 78 to secure the brace 82 to the rod 76, 78. The structure 74 further includes a bracket 90 having a U-shape attached to the body 62 of the armrest portion 60. The bracket 90 includes a top 92 attached to the body 62. The top 92 includes a pair of fingers 94 extending outwardly from the top 92 parallel to and spaced apart from one another perpendicular to the top 92 for receiving the one end 80 of the rod 76, 78. A pin 96 having a cylindrical shape extends through the fingers 94 of the bracket 90 and the one end 80 of the rod 76, 78 to secure the one end 80 to the bracket 90 and allow the rod 76, 78 to pivot about the armrest portion 60.

The brace 82 includes a hinge 98 having a rectangular shape extending between a link end 100 and a hinge end 102. The link end 100 of the hinge 98 is pivotably attached to the fin end 86 and the hinge end 102 is pivotably attached to the clamp 88 to allow the rod 76, 78 to actuate between the storage position and the load bearing position.

Figure 4:
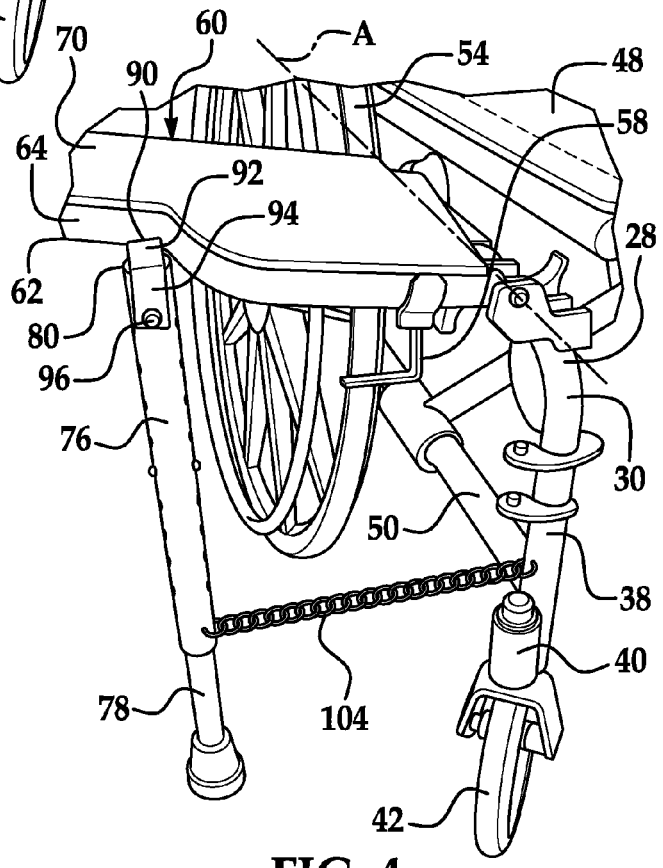
FIG. 4 is a front view of an alternative embodiment of the armrest portion in the extended portion.

Alternatively, as shown in FIG. 4, instead of a hinge 98, the brace 82 includes a chain 104 attached to the rod 76, 78 and the fin end 86 to connect the chair portion 22 and the rod 76, 78 and allow the rod 76, 78 to actuate between the storage position and the load bearing position.

In operation, the armrest portions 60 of the chair assembly 20 may first be in the upright position with the support 70 being perpendicular to the mat 48. The individual is resting on the chair portion 22 by sitting on the seat. The individual may rest their back on the cushion 46 for additional back support 70. The individual can also us the wheels 54 to propel the wheelchair in any direction.

To move the armrest portion 60 from the upright position to the extended position, the individual first releases the fastener 72 attached to the cross member 28 of the frames 24, 26 and the body 62 of the armrest portion 60. Next, the individual can push the armrest portion 60 from the upright position to the extended position. While moving from the upright position to the extended position, the support 70 of the armrest portion 60 is moving from being generally perpendicular to being generally parallel to the seat. At the same time, the rod 76, 78 of the structure 74 is moving from being generally parallel to generally perpendicular to the support 70. The brace 82 is attached to the rod 76, 78 and stays in a constant parallel relationship with the support 70 when the armrest portion 60 is being actuated between the upright position and the extended position. The brace 82 also ensures that the rod 76, 78 is always generally perpendicular to the support 70 when the armrest portion 60 is being moved from the upright position to the extended position to allow the rod 76, 78 to engage a ground to buttress the support 70.

It should be understood that many modifications and variations of the present disclosure are possible in light of the above teachings and may be practiced otherwise than as specifically described while within the scope of the appended claims. The use of the word "the" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A chair assembly comprising;

a chair portion having a seat and a back, an armrest portion comprising a body having a support arm, said arm having an upper end and a lower end, and having a support connected to said support arm and disposed adjacent to said chair portion, the armrest portion moveable between an upright position, with said upper end generally above said lower end and the support being generally perpendicular to said seat, and an extended position with said support being generally parallel to said seat, said support arm pivotably attached to said chair portion at said lower end, and a structure including a rod pivotably attached to said support adjacent to one end of said rod, said structure including a brace pivotably attached to said rod and said chair portion with said brace allowing said rod to move between a storage position with said rod being generally parallel to said support and said armrest portion being in said upright position and a load bearing position with said rod being generally perpendicular to said support and said armrest portion being in said extended position.

2. An assembly as set forth in claim 1 wherein said brace includes a fin attached to said chair portion extending outwardly from said chair portion to a fin end.

3. An assembly as set forth in claim 2 wherein said fin has a rectangular shape.

4. An assembly as set forth in claim 2 wherein said brace includes a hinge extending between a linked end pivotably attached to said fin end and a hinge end pivotably attached to said rod to allow said structure to actuate between said storage position and said load bearing position.

5. An assembly as set forth in claim 4 including a clamp slidably disposed about said rod and pivotably attached to said hinge end of said hinge connecting said brace and said rod.

6. An assembly as set forth in claim 5 wherein said clamp has a circular shape.

7. An assembly as set forth in claim 2 wherein said brace includes a chain attached to said rod and said fin end connecting said chair portion and said rod to allow said rod to actuate between said storage position and said load bearing position.

8. An assembly as set forth in claim 1 wherein said structure includes a bracket attached to said armrest portion.

9. An assembly as set forth in claim 8 wherein said bracket includes a top attached to said armrest portion and a pair of fingers extending outwardly from said top parallel and spaced apart from one another in a perpendicular relationship with said top to receive said one end of said rod.

10. An assembly as set forth in claim 9 includes a pin extending through said fingers of said bracket and said one end of said rod to allow said rod to pivot about said armrest portion.

11. An assembly as set forth in claim 1 includes a pair of wheels disposed spaced apart from one another and rotatably attached to said chair portion sandwiching said chair portion between said wheels at an acute angle relative to said back of said chair portion to provide an even weight distribution of an individual.

12. A chair assembly comprising;

a chair portion having a seat and a back, an armrest portion comprising a body having a support arm, said arm having an upper end and a lower end, and having a support connected to said support arm and disposed adjacent to said chair portion, the armrest portion moveable between an upright position, with said upper end generally above said lower end and the support being generally perpendicular to said seat and an extended position with said support being generally parallel to said seat, said support arm pivotably attached to said chair portion at said lower end, and a structure including a rod and a brace being moveable relative to said chair portion and said support with said rod and said brace being generally parallel to said support in said upright position and said rod being generally perpendicular to said support in said extended position and said brace being generally parallel to said support in said extended position.

13. An assembly as set forth in claim 12 wherein said brace includes a fin attached to said chair portion extending outwardly from said chair portion to a fin end.

14. An assembly as set forth in claim 13 wherein said fin has a rectangular shape.

15. An assembly as set forth in claim 13 wherein said brace includes a hinge extending between a linked end pivotably attached to said fin end and a hinge end pivotably attached to said rod to allow said structure to pivot between a storage position with said rod being generally parallel to said support and said armrest portion being in said upright position and a load bearing position with said rod being generally perpendicular to said support and said support being in said extended position.

16. An assembly as set forth in claim 15 includes a clamp slidably disposed about said rod and pivotably attached to said hinge end connecting said brace and said rod.

17. An assembly as set forth in claim 16 wherein said clamp has a circular shape.

18. An assembly as set forth in claim 13 wherein said brace includes a chain attached to said rod and said fin end connecting said chair portion and said rod.

19. An assembly as set forth in claim 1 wherein said structure includes a bracket attached to said armrest portion.

20. An assembly as set forth in claim 19 wherein said bracket includes a top attached to said armrest portion and a pair of fingers extending outwardly from said top parallel and spaced apart from one another in a perpendicular relationship with said top to receive said one end of said rod.

* * * * *